United States Patent [19]

Brandwijk et al.

[11] 4,295,286

[45] Oct. 20, 1981

[54] SUPPORT FRAME FOR MOTOR, PUMP AND SUCTION TUBE OF A SUCTION DREDGER

[75] Inventors: Willem Brandwijk, Nieuw-Lekkerland; Herman Dam, Alblasserdam, both of Netherlands

[73] Assignee: IHC Holland N.V., Papendrecht, Netherlands

[21] Appl. No.: 138,402

[22] Filed: Apr. 8, 1980

[51] Int. Cl.[3] ..... E02F 3/88

[52] U.S. Cl. ..... 37/58; 37/72

[58] Field of Search ..... 37/72, 58

[56] References Cited

U.S. PATENT DOCUMENTS 3,681,862 8/1972 De Koning et al. ..... 37/72 X 3,828,451 8/1974 De Koning et al. ..... 37/72 X 4,123,860 11/1978 De Koning et al. ..... 37/72

FOREIGN PATENT DOCUMENTS 980549 1/1965 United Kingdom ..... 37/58

*Primary Examiner*—Clifford D. Crowder

*Attorney, Agent, or Firm*—Young & Thompson

[57] ABSTRACT

A suction dredger and in particular a dredging tube having between a suction head and its connection to the hull of the vessel a motor pump unit which unit according to the invention is placed upon a frame which by pivotable joints interconnects the lower part and the upper part of the dredging tube. The frame has fenders protecting the dredging tube and in particular the motor pump unit against damage in case the dredging tube bounces against the hull of the vessel. The frame allows for easy maintenance and repair.

9 Claims, 9 Drawing Figures

1
2
4
5
6
7
8
9
10
11
15
16
17
19
20
22
23
24
25
29
31
V
V
IV
IV

SUPPORT FRAME FOR MOTOR, PUMP AND SUCTION TUBE OF A SUCTION DREDGER

The invention relates to a suction dredger, in particular split barge suction dredger, having a dredging tube with suction head, said dredging tube being pivotably connected to the side wall of the hull about a horizontal axis extending transversely to the said side wall, said dredging tube between its connection to the hull and its suction head having a pump with motor which in operation with the suction head at the bottom of the water operates below water level, said dredging tube between said pump and its connection to the hull having a pivot frame with one pivot axis in a vertical plane, through which frame extends a hose interconnecting the pressure conduit parts of the dredging tube whilst between said pump and its suction head a cardan joint frame has been provided through which extends a further hose interconnecting the suction tube parts of the dredging conduit.

Suction dredgers of this type are well known. The horizontal pivot axis allows different angular positions of the dredging tube necessary to adapt the tube to the depth of operation. The pivot axis in the vertical plane is necessary to allow that dredging tube and vessel can swing with respect to each other and a cardan joint serves for the same purpose and for better control of the lower or suction head portion of the tube by allowing swinging movements of vessel and dredging tube with respect to each other about a horizontal axis and about a further axis in the vertical plane.

The pivotable connection with the hull has to be at some distance from the bottom of the vessel to prevent undesired reduction of strength at the lower portion of the side wall of the hull. This, however, has the disadvantage that in operation the dredging tube with pump and motor can come into conflict with the hull of the vessel with the risk of damage of pump and conduit portions in particular when motor and pump form a unit interconnecting the parts of the dredging tube.

This advantage is even more serious with a split barge suction dredger, the hull of which being formed by two halves which are pivotably connected with each other about a horizontal longitudinal axis. If the halves move apart to discharge the load a collision with the suction tube can only be avoided if the tube is completely lifted out of the water.

Purpose of the invention is to provide a suction dredger with a dredging tube in which this disadvantage has been avoided.

According to the invention this is achieved in that said cardan joint frame and said vertical pivot frame form integral parts of a support frame, carrying motor and pump as well as the adjacent part of the suction tube and the part of the pressure conduit tube between cardan joint and vertical pivot frame respectively, said support frame at the side turned towards the hull having one or more fenders extending outside the longitudinal profile of the support frame and the motor and the pump and the tube parts supported by it. This support frame with its fender or fenders first of all prevents the risk of damage of the motor and pump and of the conduits in case the dredging tube bounces against the hull of the vessel.

Further, stresses which during operation occur in the dredging tube structure can now be held free from the pump unit. Motor and pump now can resilienty be supported by the supporting frame in a manner which allows disassembly of them from the frame in case of repair or maintenance.

According to the invention the said suppport frame may comprise at least two profiles spaced apart and interconnected by a plurality of transversely extending profiles which two spaced apart profiles at the location of motor and pump unit have a larger distance from each other than at the ends which are joined with the pivot frames, the transversely extending profiles forming the supports for pump, motor and tube portions. Said frame structure may be composed of any type of profile but preferably is made from hollow profiles of rectangular or circular crossection. The main profiles which substantially extend in the longitudinal direction of the dredging tube may be in a plane parallel to the horizontal axis of the cardan joint or may be arranged in a plane extending at an angle to said horizontal axis.

Preferably motor, gear transmission and pump form a unit.

A very short structure is obtained if a low speed electromotor is directly connected to the pump to form a unit without any gear transmission, because motor and pump have the same speed.

Said frame can be used to support the energy supply to the motor such as electric conduits or hydraulic conduits. In case the suction head uses water injection nozzles the frame may support or form the pressure water conduit towards the suction head.

The invention now will be further elucidated with reference to the drawings.

Figure 1:
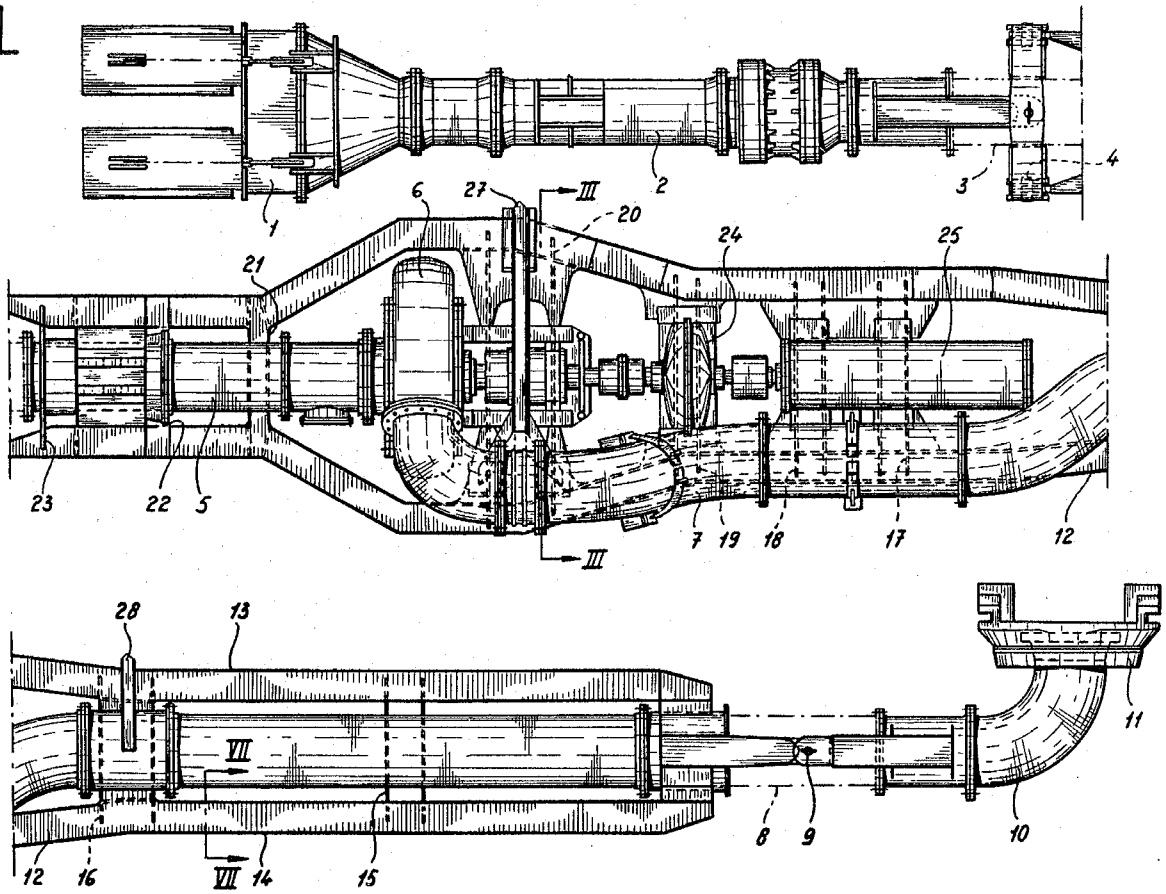
FIG. 1 shows a top view of the dredging tube with frame according to the invention.

FIG. 1 discloses a dredging tube having a suction head 1, a lower suction tube part 2, a hose 3 extending through a cardan joint 4, a further suction tube part 5, a centrifugal pump 6, a pressure conduit 7, a hose 8 at the location of the pivot 9 and a pressure conduit with elbow 10 which with its connecting portion 11 is secured in a well known manner to the side wall of the hull of the vessel which side wall is not shown. At the inner side of the hull there is a not shown connection to the discharge conduit debouching in the hole of the vessel.

The vertical pivot 9 is of a well known fork-like structure enabling swinging movements of the dredging tube about an axis extending in a vertical plane.

The cardan joint 4 also is of a well known structure.

The hoses 3 and 8 extend through said pivotable joints also in a well known manner to provide for a continuation of the dredging tube in its suction part and pressure part.

According to the invention the joints 9 and 4 form integral parts with a frame 12 formed of longitudinally extending hollow profiles 13 and 14 of rectangular structure. Said profiles 13 and 14 are interconnected by hollow profiles 15, 16, 17, 18, 19, 20, 21, 22 and 23.

Figure 2:
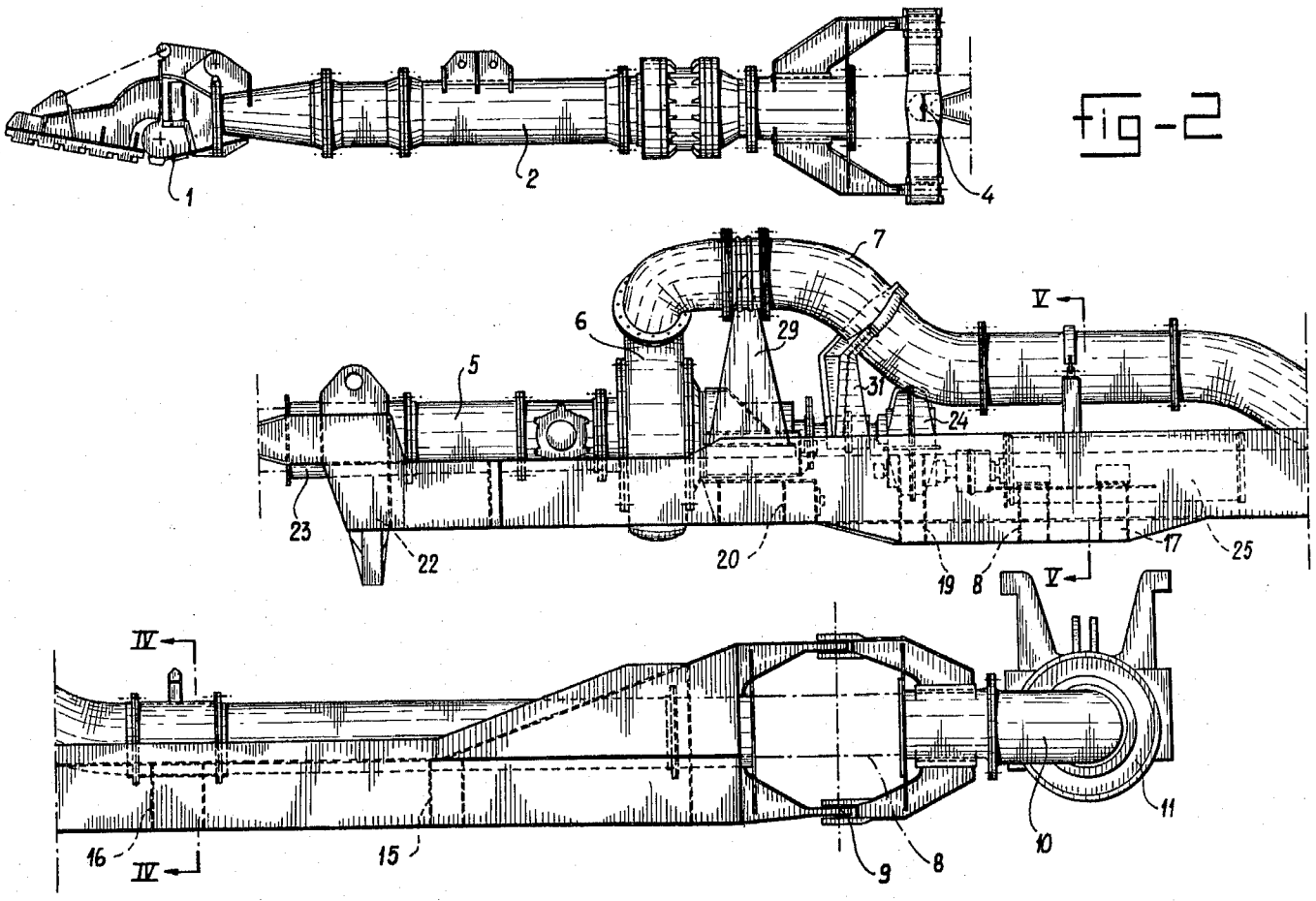
FIG. 2 is a side view of the dredging tube and frame according to FIG. 1.
Figure 3:
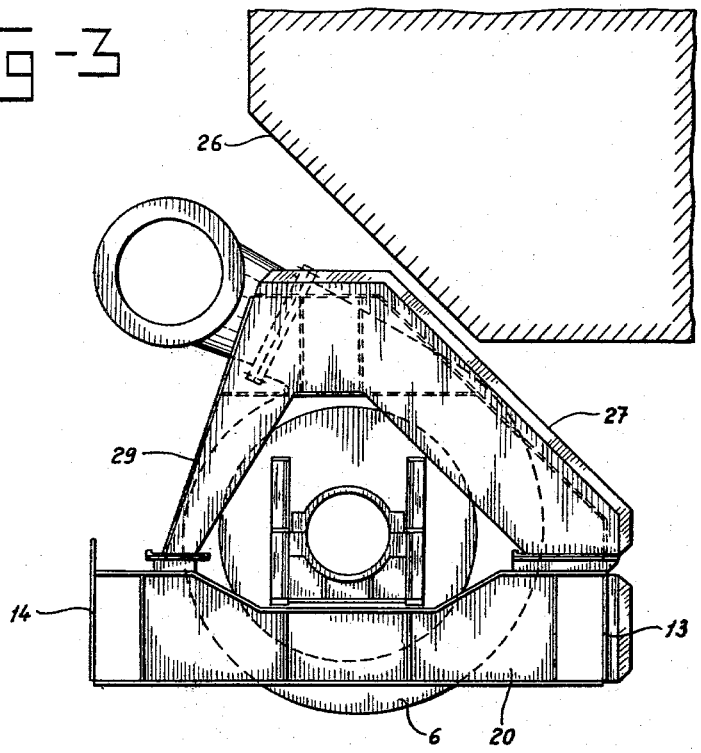
FIG. 3 is a crossection according to the line III—III of FIG. 1.

As can be seen from FIGS. 1, 2 and 3 the pump 6 is supported by the transversely extending profile 20. Profile 19 does support a reduction gear transmission 24 and the profiles 17 and 18 support the motor 25.

Figure 4:
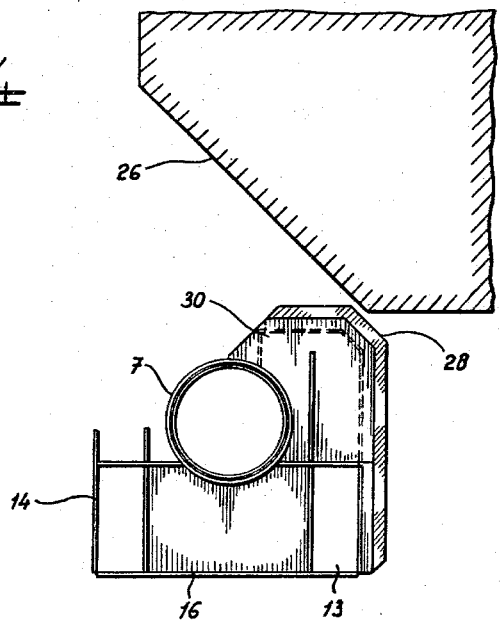
FIG. 4 is a crossection according to the line IV—IV of FIG. 2.

In FIGS. 3 and 4 the underside of the vessel is indicated with the line 26.

FIGS. 3 and 4 disclose fenders 27 and 28 formed by a resilient profile such as a rubber strip attached to a vertical frame portion 29 and 30 respectively.

Figure 5:
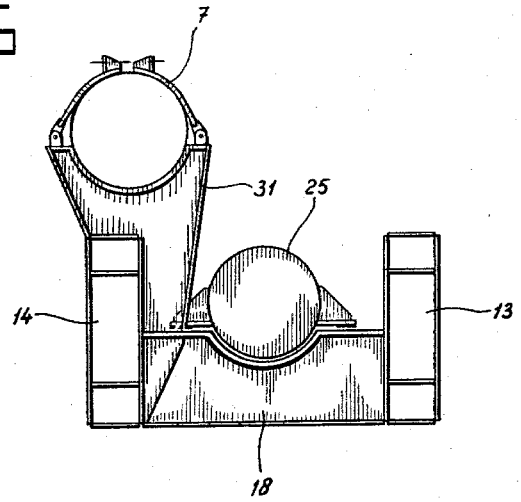
FIG. 5 is a crossection according to the line V—V of FIG. 2.

FIGS. 4 and 5 also show how the transversely extending profiles support the tube 7 and the motor 25. FIG. 5 in addition shows an additional support of the upwardly curved portion of the pressure tube 7 to connect it to the outlet of the pump 6. This support has the reference 31.

Figure 6:
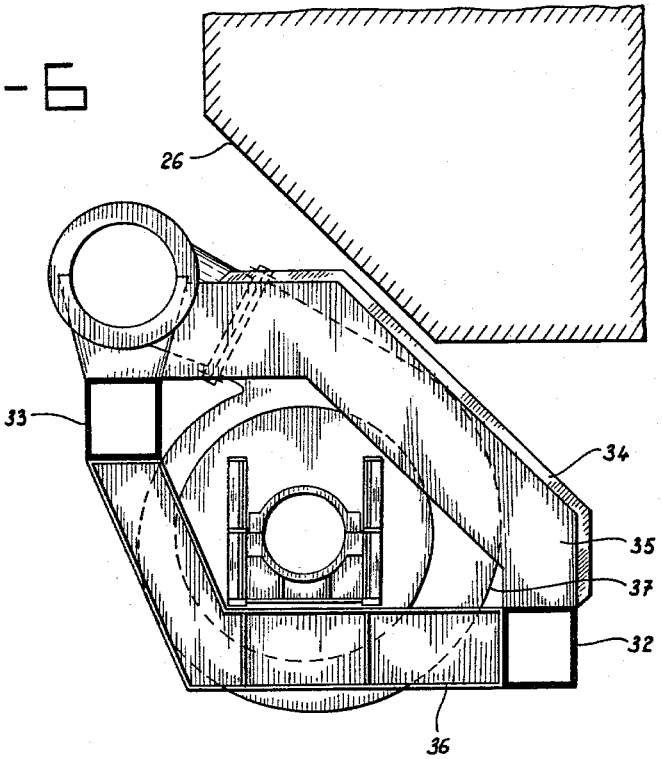
FIG. 6 is a crossection similar to FIG. 3 through a different embodiment.

FIG. 6 discloses a frame structure with the main profiles 32 and 33 at different levels, with a fender 34 on a frame part 35 and a support 36 for the pump 37.

As can be seen most clearly from FIGS. 1, 2, 5 incl. all conduit parts can be easily disassembled and which is of more importance the same holds true for motor 25, gear transmission 24 and pump 6. Accordingly for repair or maintenance the entire dredging tube structure need not to be taken apart into pieces because removal of the parts supported by the frame 12 does not take away the connection between the lower tube 2 with suction head 1 and the upper part 10.

Figure 7:
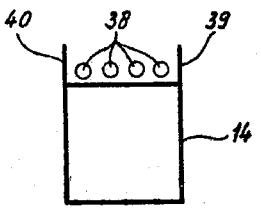
FIG. 7 is a crossection through one of the profiles e.g. according to the line VII—VII of FIG. 1.

FIG. 7 shows by way of example how the rectangular profile 14 can be used to support power lines 38 and the like in a channel formed by upwardly extending flanges 39 and 40.

Figure 9:
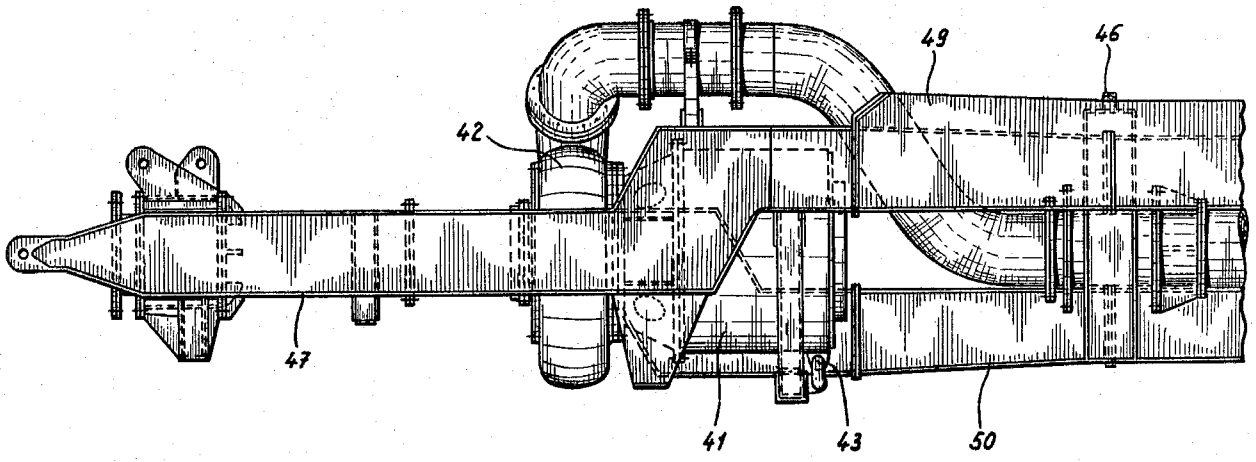
FIG. 9 is a side view of the embodiment of FIG. 8.
Figure 8:
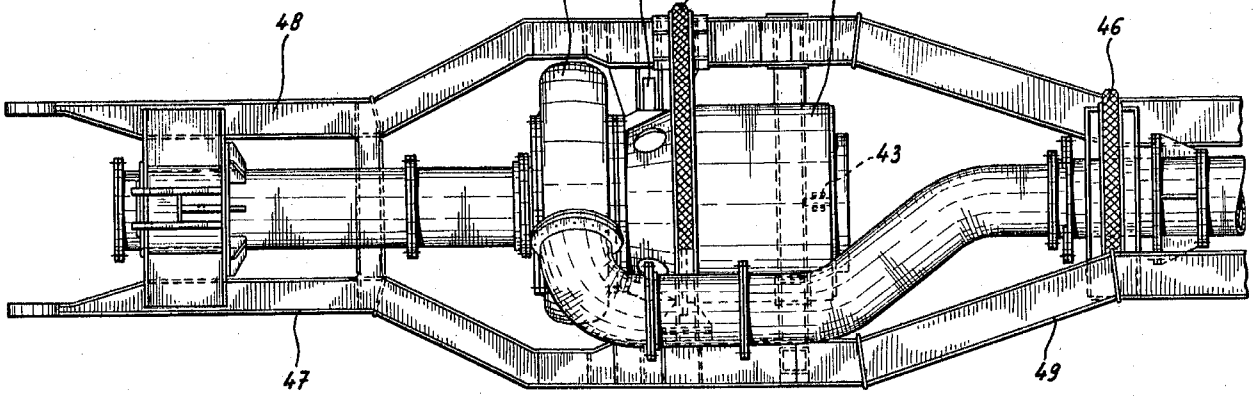
FIG. 8 is a top view of a different embodiment.

FIGS. 8 and 9 disclose a different embodiment of motor and pump. The motor 41 is a low speed electromotor or hydromotor rotating with the same speed as the pump 42. Motor 41 and pump 42 are flanged together to form a unit. Said unit can be rigidly or resiliently through silent blocks be supported by the frame e.g. at 43 and 44. The fenders are shown at 45 and 46.

This unit allows a shorter length of the broad portion of the frame. For repair or maintenance the entire unit can be removed or replaced.

The frame is of a different shape, the beams 47, 48 extending downwardly of the unit are in the same plane, whilst the upwardly extending beams 49, 50 are in different planes.

We claim:

1. A suction dredger having a dredging tube with suction head, said dredging tube being pivotably connected to the side wall of the hull about a horizontal axis extending transversely to the side wall, said dredging tube between its connection to the hull and its suction head having a pump unit with a motor which in operation with the suction head at the bottom of the water operates below water level, said dredging tube between the pump and its connection to the hull having a pivot frame with one pivot axis in a vertical plane, through which frame extends a hose interconnecting the pressure conduit parts of the dredging tube while between said pump and its suction head a cardan joint frame has been provided through which extends a further hose interconnecting the suction tube parts of the dredging conduit, said cardan joint frame and said vertical pivot frame forming integral parts of a support frame, carrying the motor and the pump as well as the adjacent part of the suction tube and the part of the pressure conduit tube between cardan joint and vertical pivot frame respectively, said support frame at the side turned towards the hull having one or more fenders extending outside the longitudinal profile of the support frame and the motor and the pump and the tube parts supported by it.

2. Suction dredger as claimed in claim 1 wherein the said support frame comprises at least two profiles spaced apart and interconnected by a plurality of transversely extending profiles which two spaced apart profiles at the location of the motor and the pump have a larger distance from each other than at the ends which are joined with the pivot frames, the transversely extending profiles forming the supports for the pump, the motor and the water and tube portions.

3. Suction dredger as claimed in claim 2 wherein the support frame is composed of hollow profiles.

4. Suction dredger as claimed in claim 3 wherein the hollow profiles have a rectangular crossection.

5. Suction dredger as claimed in claim 3 wherein the hollow profiles have a circular crossection.

6. Suction dredger as claimed in claim 2 wherein the two profiles extending substantially in the longitudinal direction of the support frame lie in a plane parallel to the horizontal axis of the cardan joint.

7. Suction dredger as claimed in claim 2 wherein the two profiles of the support frame extending substantially in the longitudinal direction of said frame are displaced with respect to each other according to a plane extending at an angle to the horizontal axis of the cardan joint.

8. Suction dredger as claimed in claim 1 wherein the frame supports the energy supply of the motor of the unit.

9. Suction dredger as claimed in claim 1 wherein the frame supports a pressure water conduit extending towards the suction head.

* * * * *